US005943030A

United States Patent [19]

Minamibayashi

[11] Patent Number: 5,943,030

[45] Date of Patent: Aug. 24, 1999

[54] DISPLAY PANEL DRIVING CIRCUIT

[75] Inventor: Seisaku Minamibayashi, Tokyo, Japan

[73] Assignee: NEC Corporation, Tokyo, Japan

[21] Appl. No.: 08/756,255

[22] Filed: Nov. 25, 1996

[30] Foreign Application Priority Data

Nov. 24, 1995 [JP] Japan ..... 7-305353

[51] Int. Cl.[6] ..... G09G 3/28

[52] U.S. Cl. ..... 345/60; 345/41; 345/42; 345/61; 345/62; 345/76; 345/212; 315/169.3

[58] Field of Search ..... 345/41, 42, 60, 345/61, 62, 76; 315/169.3

[56] References Cited

U.S. PATENT DOCUMENTS

| | | | |
|---|---|---|---|
| 4,707,692 | 11/1987 | Higgins et al. | 340/805 |
| 4,859,910 | 8/1989 | Iwakawa et al. | 315/169.1 |
| 4,866,349 | 9/1989 | Weber et al. | 315/169.4 |
| 4,958,105 | 9/1990 | Young et al. | 315/169.3 |
| 5,003,228 | 3/1991 | Hada et al. | 315/169.4 |
| 5,227,696 | 7/1993 | Asars | 315/169.3 |
| 5,438,290 | 8/1995 | Tanaka | 327/108 |
| 5,550,557 | 8/1996 | Kapoor et al. | 345/76 |
| 5,559,402 | 9/1996 | Corrigan, III | 315/169.3 |
| 5,654,728 | 8/1997 | Kanazawa et al. | 345/68 |
| 5,670,974 | 9/1997 | Ohba et al. | 345/60 |

FOREIGN PATENT DOCUMENTS

| | | |
|---|---|---|
| 0657862 | 6/1995 | European Pat. Off. . |
| 63-101897 | 5/1988 | Japan . |
| 5-265397 | 10/1993 | Japan . |
| 5-81912 | 11/1993 | Japan . |

*Primary Examiner*—Dennis-Doon Chow
*Assistant Examiner*—Amr Awad
*Attorney, Agent, or Firm*—Sughrue, Mion, Zinn, Macpeak & Seas, PLLC

[57] ABSTRACT

A display panel driving circuit includes a plurality of elementary driver circuits each provided for each one of drive electrodes, an electric power recovery common line, an electric power release common line, first and second coils having one end thereof connected to the electric power recovery common line and the electric power release common line, respectively, and a capacitor having one end connected in common to the other end of the first and second coils. Each of the elementary driver circuits includes a first switch on-off controlled to recover a recovery current from a corresponding drive electrode to an electric power recovery line, a second switch on-off controlled to selectively connect the corresponding drive electrode to a low potential power supply line, a third switch on-off controlled to supplying a recovered electric current from an electric power release line to the corresponding drive electrode, and a fourth on-off controlled to selectively connect a high potential power supply line to the corresponding drive electrode. The electric power recovery common line is connected in common to the electric power recovery line of all the elementary driver circuits, and the electric power release common line is connected in common to the electric power release line of all the elementary driver circuits. The first to fourth switches of each of the elementary driver circuits are so controlled that each of the elementary driver circuits can perform the electric power recovery operation and the electric power release operation simultaneously in parallel to those of the other elementary driver circuits. Thus, the electric power recovery/release can be carried out not only in the display cell sustain discharge driving period but also in the display data writing period.

8 Claims, 9 Drawing Sheets

DISPLAY PANEL DRIVING CIRCUIT

BACKGROUND OF THE INVENTION

1. Field of the Invention

The present invention relates to a display panel driving circuit, and more specifically to a driving circuit for a display panel constituting a capacitive load, such as an AC drive type plasma display panel (abbreviated as "PDP") and an electro-luminescence (abbreviated as "EL") display.

2. Description of Related Art

Since a surface-discharge AC drive type plasma display panel has various advantages such as a thinness, a high brightness, and a high resolution, a study for enlarging the screen size is now being energetically pushed ahead as a leading display element for a wall television receiver set. In such an application to the display device, since the plasma display panel is essentially a large capacitive load, a drive circuit for the plasma display panel is designed by taking the capacitive load into consideration.

Referring to FIG. 1, there is shown a diagram illustrating a basic construction of the AC drive type plasma display panel including a conventional drive circuit. The shown plasma display panel apparatus includes a display panel 10 to be driven, a pair of data electrode drive circuits 20 for driving a number of data electrodes Xi (i=1~n) of the display panel 10, a scan electrode drive circuit 30 for driving a number of scan electrodes Yj (j=1~m) of the display panel 10, and a common electrode drive circuit 40 for driving a number of common electrodes Z of the display panel 10.

As well known to persons skilled in the art, the display panel 10 is so configured that, the data electrodes Xi are located on one surface separated from one another, and on an opposing surface which is located to face the one surface with a predetermined spacing, the scan electrodes Yj and the common electrodes Z are alternately located to extend orthogonally to the data electrodes Xi. Each of the common electrodes is located closely to but apart from a corresponding one of the scan electrode Yj, so that one common electrode and one scan electrode are paired with. All the common electrodes are connected in common at their one ends. These three kinds of electrodes Xi, Yj and Z are electrically insulated from one another, and therefore, are mutually capacitively coupled to one another.

A display cell 11, C(ij) is constituted at an intersection of one date electrode Xi and one scan electrode Yj and its associated common electrode Zj. Therefore, a number of display cells are located in the form of a matrix. A light emitting discharge is generated in a gap of the above mentioned predetermined spacing by applying an AC pulse by action of the respective drive circuits. In each application of the AC pulse, a capacitance of the electrodes associated to the display cell is charged and discharged. In certain display panels, a reactive current attributable to this charge/discharge becomes larger than a discharge current when the applied voltage exceeds a threshold voltage of the light emitting discharge.

Referring to FIG. 2, there is shown a timing chart illustrating one example of a method for driving the plasma display panel. FIG. 2 shows driving waveforms for a display period corresponding to one frame of binary image.

The display period of one frame is divided into a pre-discharge period, a data write period and a sustain discharge period. In the pre-discharge period which is a first period of each one display period, while maintaining all the data electrodes at a ground level GND, a negative erase pulse Vap is applied to all the scan electrodes, and then, a negative discharge pulse Vp is applied to all the common electrodes Z, in order to erase a display content of a preceding frame and to be ready for a wall charge for a writing of a new display data.

In the data write period which is a second period of each one display period, a line sequential writing is conducted on the basis of a new display data. For the first scan electrode $Y_1$ of the display panel, a positive data pulse voltage Vd is applied to the data electrode Xi for a display cell to be lighted, but the data electrode Xi for a display cell not to be displayed is maintained at the ground level GND. On the other hand, a negative scan pulse voltage Vw is applied to the scan electrode $Y_1$, so that a write discharge occurs between the scan electrode and the data electrode applied with the positive data pulse voltage Vd, with the result that the wall charge is created. Succeedingly, a similar operation is repeated for the remaining scan electrodes $Y_2$ to Ym in the order from the second scan electrode $Y_2$ to the final scan electrode Ym.

In the sustain discharge period following the data write period, a negative sustain pulse Vs is applied alternately and exclusively to the common electrodes Z and the scan electrodes Yj, as shown in FIG. 2, so that the discharge is sustained in cells in which the wall charge is created in the preceding writing operation. This alternate exclusive application of the sustain pulse is repeated "k" times, so that an image of one frame is display.

The following is a specific numerical example. The repetition number "k" is on the order of 200 to 500, and the sustain pulse voltage Vs is on the order of −160 V to −180 V. The scan pulse voltage Vw is on the order of −160 V to −200 V, and the erase pulse voltage Vap is on the order of −140 V to −190 V. The data pulse voltage Vd is on the order of +60 V to +80 V, and the pre-discharge pulse voltage is on the order of −300 V to −350 V.

In the driving as mentioned above of the AC drive type plasma display panel, since the applied voltage is large and the load capacitance is large, it is in some cases that the reactive power consumed in the capacitance associated with the display cells reaches 50% or more of the overall consumed electric power. In addition, a heating and a definite driving capacity of driving elements included in the drive circuits often become a problem, which will become remarkable with demands for an elevated brightness of the display and an increased amount of the display information.

In order to overcome the above mentioned problems, various proposals have been made in the prior art. For example, Japanese Patent Post-examination Publication No. JP-B-5-081912, which corresponds to U.S. Pat. No. 4,707,692, the disclosure of which is incorporated by reference in its entirety into this application, proposes a display panel driving circuit so constructed that a coil is connected to one of electrodes of a capacitive load, and an electric charge charged in display cells is recovered into a capacitance of a power supply line by use of resonance. This will be called a first prior art display panel driving circuit hereinafter.

In addition, Japanese Patent Application Pre-examination Publication No. JP-A-63-101897, which corresponds to U.S. Pat. No. 4,866,349, the disclosure of which is incorporated by reference in its entirety into this application, proposes a display panel driving circuit constructed to have a dedicated capacitor for recovering and releasing an energy by utilizing about one half of a pulse voltage. This will be called a second prior art display panel driving circuit hereinafter.

Furthermore, Japanese Patent Application Pre-examination Publication No. JP-A-5-265397, the disclosure of which is incorporated by reference in its entirety into this application, proposes a display panel driving circuit so constructed as to recover and re-use an electric power of the sustain pulse by utilizing a coil having one end connected in common to one end of diodes which have the other end connected to individual scan electrodes, respectively, so that an electric power of the sustain pulses is recovered and re-used in a time-division manner. This will be called a third prior art display panel driving circuit hereinafter.

On the other hand, the electric power consumption in the data writing period remarkably increases when the plasma display panel is used as a high quality television image display which is an estimated dominant use of the plasma display panel, because (1) the execution number of the data writing for each sub-frame as the result of the frame division for a half tone display is increased (for example, 8 data writings are required for the display for 256 gray scales), (2) the number of the data electrodes is increased for a color display (namely, becomes three times for red, green and blue), and (3) the number of required data electrodes is also increased for a wide screen display.

However, the first and second prior art display panel drive circuits becomes inevitably large in size if one coil is connected to each of independent electrodes.

Furthermore, the third prior art display panel drive circuit is so configured to cope with only the sustain discharge period which consumes a maximum electric power in the prior art plasma display panel, and therefore, can handle neither the scan pulse which is applied only one for one scan electrode in each one frame period, nor the data pulses applied to the data electrodes, which would require a high speed parallel and mixed operation of recovery and release of an electric power.

Accordingly, the disadvantage of the first to third prior art display panel drive circuits that it is not possible to recover and re-use the electric charge applied during the data write period, becomes a large problem when the plasma display panel is used as a high quality television image display, In order to realize the electric power recovery not only in the sustain discharge period but also in the data write period, there are various problems to be solved as follows:

A first problem is to realize a number of drivers which are formed on a single integrated circuit and which can individually recover and re-use a charging and discharging electric power on each of individual electrodes and also can realize a parallel and mixed operation of the recovery and the discharge, compatibly with a high speed data.

A second problem is to realize a number of drivers and a control circuit therefor, which can realize the above mentioned operation for pulses which are different in amplitude and in potential.

A third problem is to realize a method for operating a number of drivers formed on the integrated circuit, simultaneously and in parallel.

SUMMARY OF THE INVENTION

Accordingly, it is an object of the present invention to provide a display panel driving circuit which has overcome the above mentioned defects of the conventional ones.

Another object of the present invention is to provide a display panel driving circuit capable of recovering and re-using the charge/discharge electric power of display cells not only in the sustain discharge period but also in the data write period, and therefore, capable of greatly reducing the electric power consumption of the display panel.

The above and other objects of the present invention are achieved in accordance with the present invention by a circuit for driving a display panel which includes a number of display cells located in the form of a matrix and comprises a plurality of drive electrodes which are independent of one another and which constitute a capacitive load, the driving circuit being configured to drive each of the plurality of drive electrodes by an AC drive pulse and to recover a reactive electric power attributable to the capacitive load so as to supply the recovered electric power together with a next drive pulse, for the purpose of improving a driving efficiency, the driving circuit comprising:

a plurality of elementary driver circuits each provided for each one of the drive electrodes, each including:

a first switch connected between a corresponding one of the drive electrodes and an electric power recovery line, and on-off controlled to recover from the corresponding drive electrode a recovery current corresponding to the reactive electric power;

a second switch connected between the corresponding drive electrode and a low potential power supply line, and on-off controlled to selectively connect the corresponding drive electrode to the low potential power supply line;

a third switch connected between the corresponding drive electrode and an electric power release line, and on-off controlled to supplying a recovered electric current to the corresponding drive electrode; and a fourth switched connected between the corresponding drive electrode and a high potential power supply line, and on-off controlled to selectively connect the high potential power supply line to the corresponding drive electrode;

a first common line connected in common to the electric power recovery line of the plurality of elementary driver circuits;

a second common line connected in common to the electric power release line of the plurality of elementary driver circuits;

first and second inductors having one end thereof connected to the first and second common lines, respectively;

a first capacitor having one end connected in common to the other end of the first and second inductors and the other end connected to a predetermined potential; and a driver control circuit for supplying switch control signals to the first to fourth switches of each of the plurality of elementary driver circuits.

The above and other objects, features and advantages of the present invention will be apparent from the following description of preferred embodiments of the invention with reference to the accompanying drawings.

DESCRIPTION OF THE PREFERRED EMBODIMENTS

Figure 3:
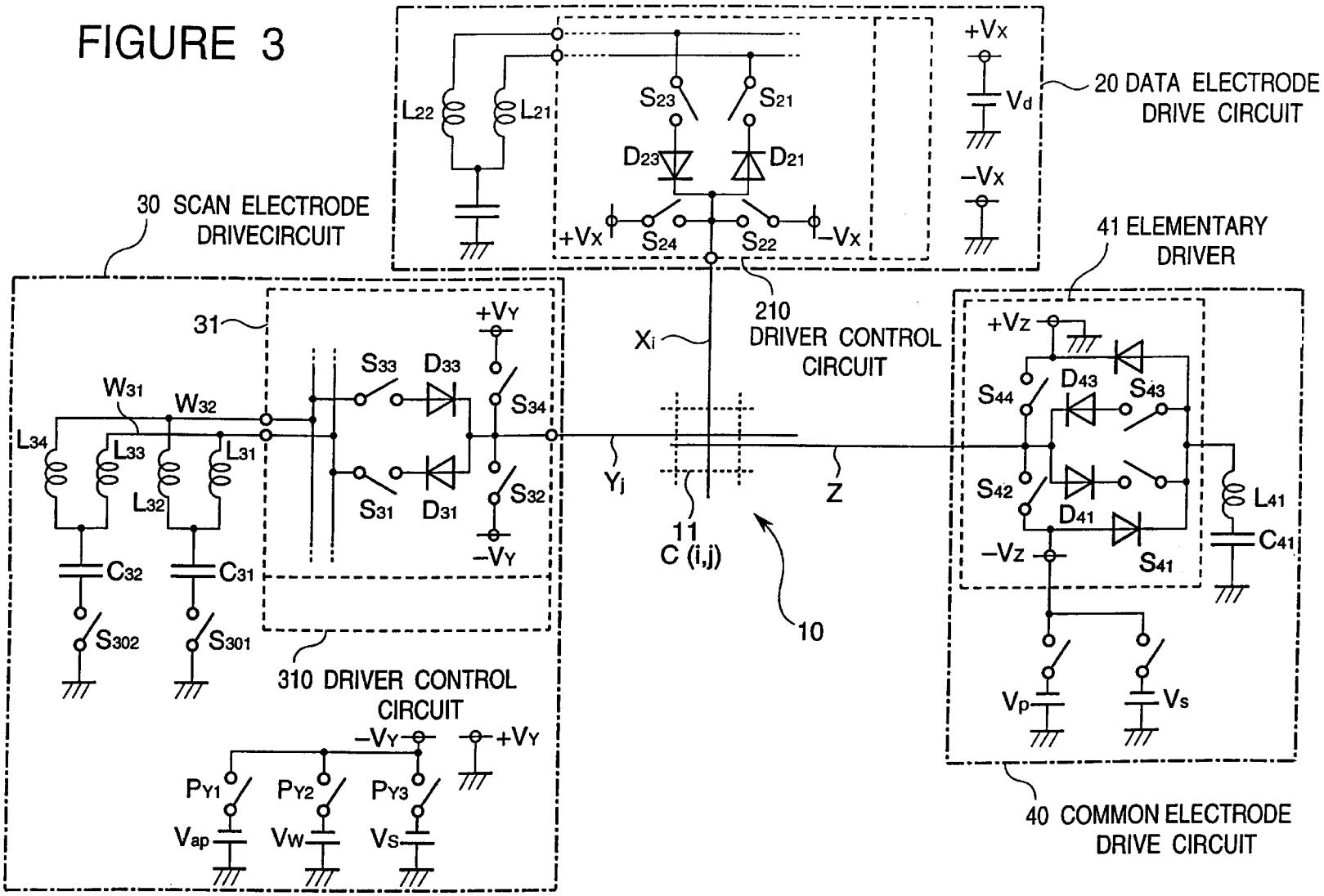
FIG. 3 is a block diagram illustrating the whole construction of one embodiment of the display panel drive circuit in accordance with the present invention.

Referring to FIG. 3, there is shown a block diagram illustrating the whole construction of one embodiment of the display panel drive circuit in accordance with the present invention.

Figure 1:
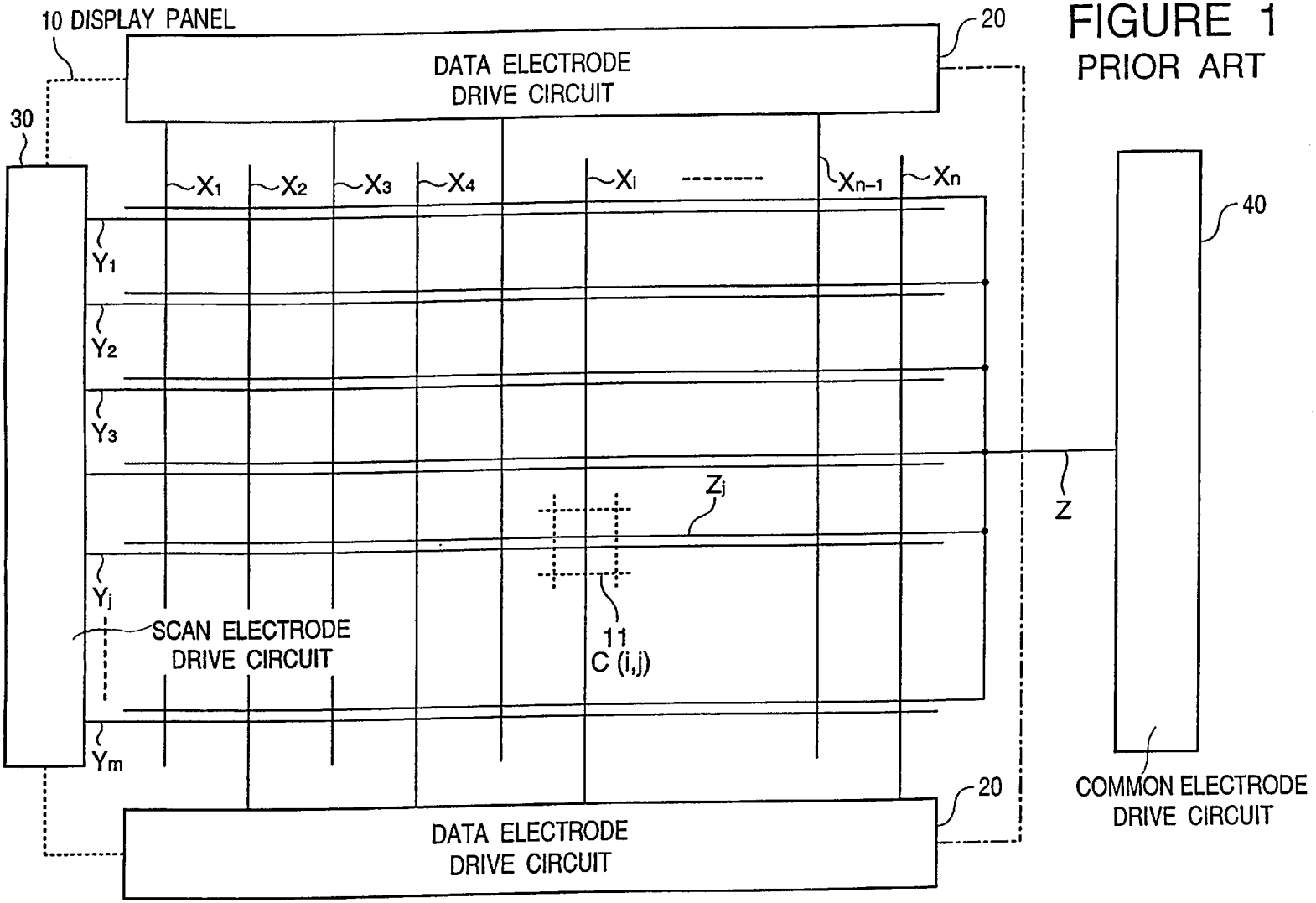
FIGURE 1 PRIOR ART
FIG. 1 is a block diagram illustrating a basic construction of the AC drive type plasma display panel including a conventional drive circuit.
Figure 2:
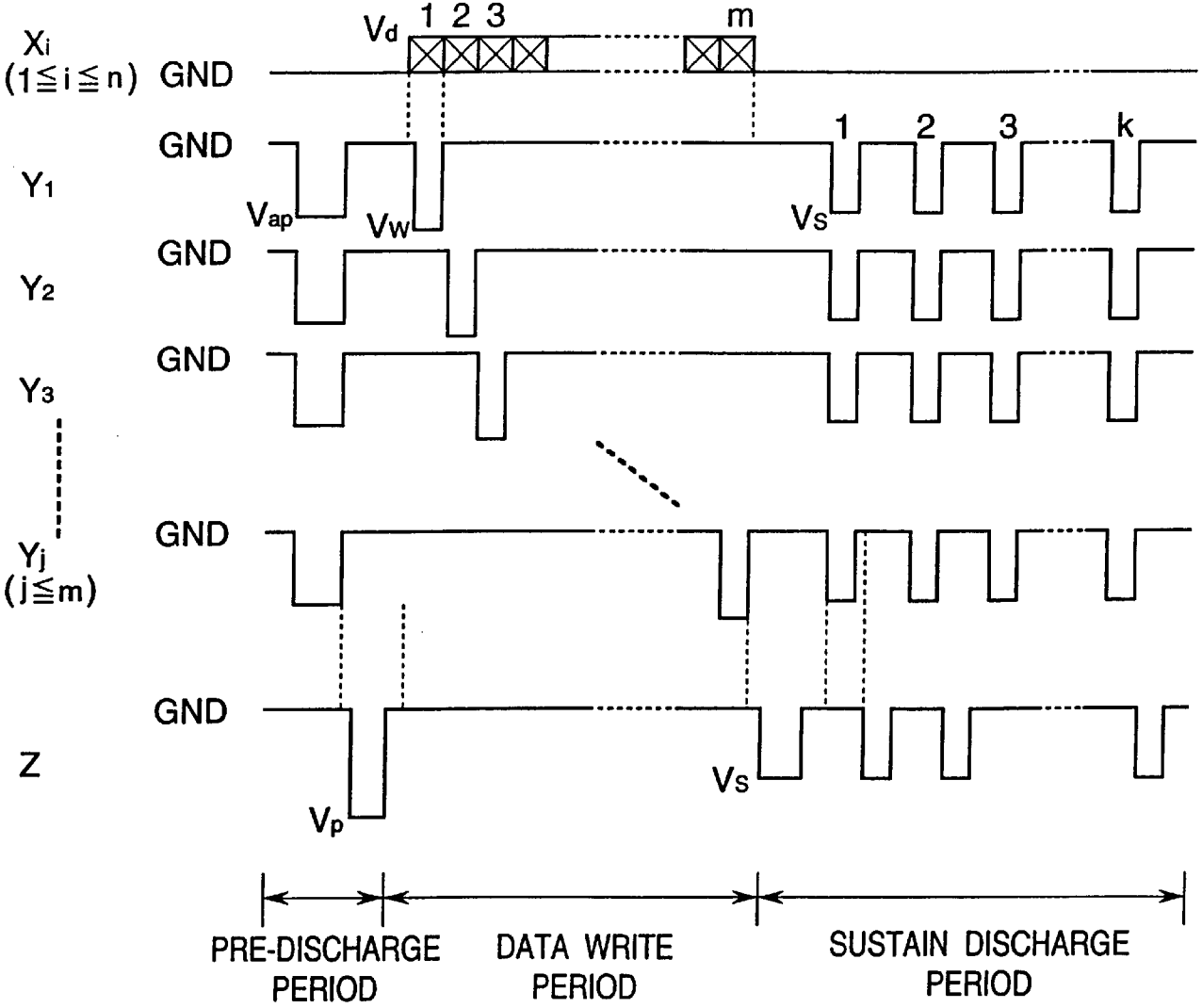
FIGURE 2 PRIOR ART
FIG. 2 is a timing chart illustrating one example of a method for driving the plasma display panel, in a display period corresponding to one frame of binary image.

As explained hereinbefore with reference to FIG. 1, a display panel includes a number of display cells which arranged in the form of a matrix having a plurality of rows and a plurality of columns, and therefore, includes a plurality of independent data electrodes, a plurality of independent scan electrodes and a plurality of common electrodes connected in common. In FIG. 3, however, the display cell is generally designated by Reference Numeral 10, and is represented by one one display cell 11 Cij for simplification of drawing, and the plurality of independent data electrodes are represented by one data electrode Xi and the plurality of independent scan electrodes are represented by one scan electrode Yj. In addition, the common electrodes are represented by one common electrode Z.

The shown display panel drive circuit includes a data electrode drive circuit 20 for driving the plurality of independent data electrodes represented by the data electrode Xi, a scan electrode drive circuit 30 for driving the plurality of independent scan electrodes represented by the scan electrode Yj and a common electrode drive circuit for driving the common electrode Z.

As will be explained hereinafter, each of the data electrode drive circuit 20 and the scan electrode drive circuit 30 includes a plurality of elementary drivers each provided for a corresponding one of a plurality of individual electrodes provided for the number of display cells Cij, respectively, for the purpose of individually supplying a AC pulse to the corresponding electrode and individually performing an electric power recovery operation and an electric power release operation for the corresponding electrode. Furthermore, each of the data electrode drive circuit 20 and the scan electrode drive circuit 30 includes coils and a capacitor or capacitors for the electric power recovery/release.

The common electrode drive circuit 40 includes an electrode driver 41 similar to the above mentioned elementary driver, and a coil $L_{41}$ and a capacitor $C_{41}$, and is connected selectively to either the negative discharge pulse voltage Vp and the sustain discharge pulse voltage Vs.

Figure 4:
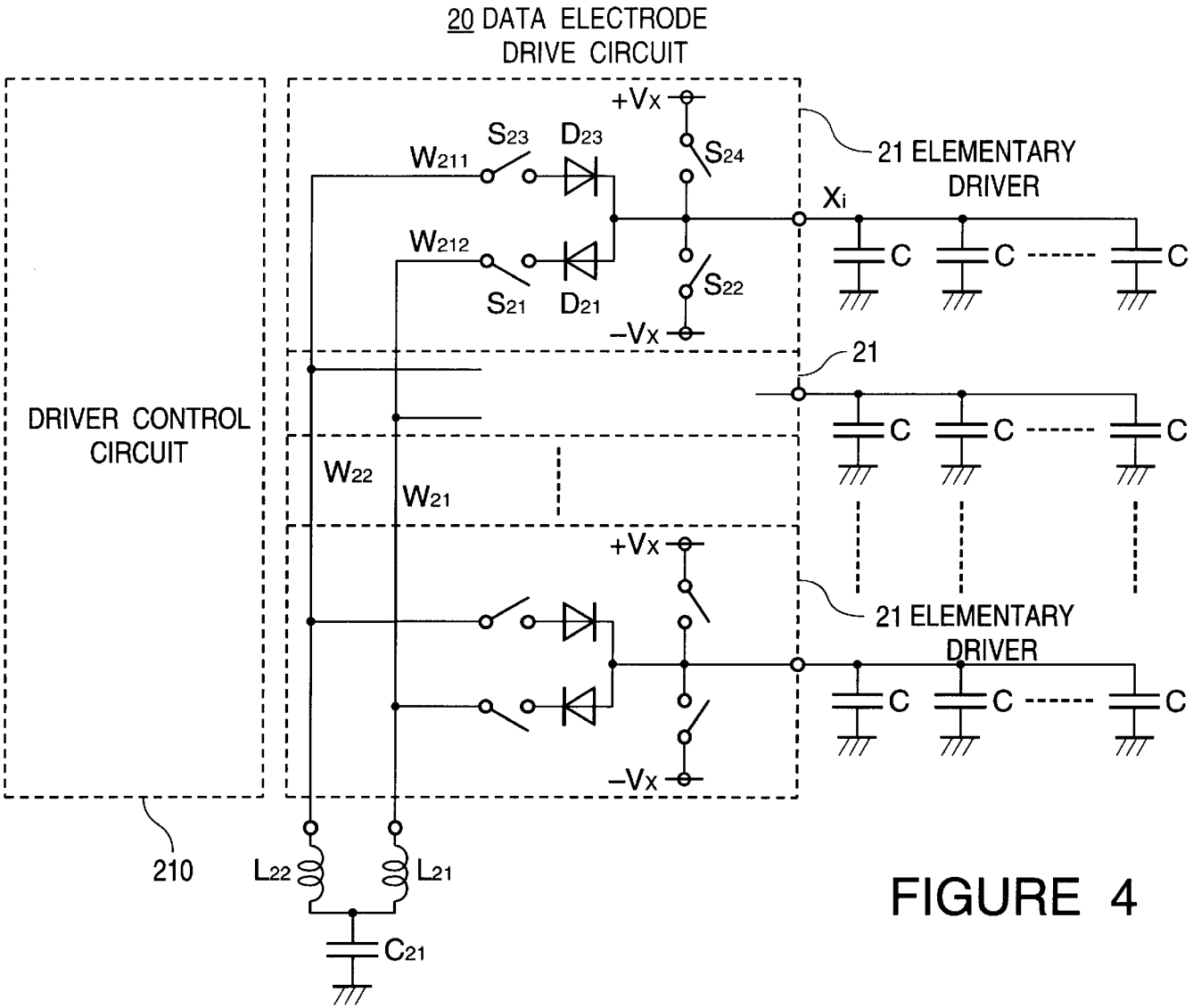
FIG. 4 is a circuit diagram of a data electrode driving circuit in the display panel drive circuit shown in FIG. 3.

Referring to FIG. 4, there is shown a circuit diagram of the data electrode driving circuit 20 in the display panel drive circuit shown in FIG. 3.

The data electrode driving circuit 20 includes a plurality of elementary drivers 21 each provided for a corresponding one of the plurality of data electrodes, each of which is connected to a plurality of capacitors C, which represent the associated display cells Cij. As mentioned above, each of elementary drivers 21 is configured to individually supply a AC pulse to the corresponding data electrode and to individually perform an electric power recovery operation and an electric power release operation for the corresponding data electrode.

The data electrode driving circuit 20 also includes a pair of dedicated coils $L_{21}$ and $L_{22}$ connected at their one end to an electric power recovery common line $W_{21}$ and an electric power release common line $W_{22}$, respectively, which are independent of each other, and a common capacitor $C_{21}$ having one end connected in common to the other end of the coils $L_{21}$ and $L_{22}$. The other end of the capacitor $C_{21}$ is grounded.

Each of the elementary drivers 21 includes a reverse-current preventing diode $D_{21}$ for an electric power recovery current and having an anode connected to the corresponding data electrode Xi to be driven, a first switch $S_{21}$ having one end connected to a cathode of the diode $D_{21}$ and the other is connected to an electric power recovery line $W_{212}$, a second switch $S_{22}$ connected between the corresponding data electrode Xi and a low potential power supply −Vx for bringing the corresponding data electrode Xi to the low potential power supply voltage −Vx after the electric power recovery, a reverse-current preventing diode $D_{23}$ for an electric power release current and having a cathode connected to the corresponding data electrode Xi to be driven, a third switch $S_{23}$ having one end connected to an anode of the diode $D_{23}$ and the other and connected to an electric power release line $W_{211}$, a fourth switch $S_{24}$ connected between the corresponding data electrode Xi and a high potential power supply +Vx for bringing the corresponding data electrode Xi to the high potential power supply voltage +Vx after the electric power release. The electric power recovery line $W_{212}$ and the electric power release line $W_{211}$ of each of the elementary drivers are concentrated and connected to the electric power recovery common line $W_{21}$ and the electric power release common line $W_{22}$, respectively.

Furthermore, the data electrode driving circuit 20 includes a driver control circuit 210 for individually controlling the switches $S_{21}$ to $S_{24}$ of each elementary driver 21.

For convenience of description, a detailed construction and a detailed operation of the data electrode driving circuit 20 will be explained hereinafter in connection to elementary drivers 31 of the same construction in the scan electrode drive circuit 30.

Now, an overall operation will be described of the shown embodiment will be described with reference to FIGS. 3 and 4. First, since each of the data electrode driving circuit 20 and the scan electrode drive circuit 30 is constituted by locating a plurality of elementary drivers 21 and 31 in parallel, individual electric power recovery/release operations are be executed in parallel. Secondly, explaining the data electrode drive circuit 20 as an example for convenience for description, since the electric power recovery common lines $W_{21}$ and the electric power release common lines $W_{22}$ are provided independently of each other, the electric power recovery current and the electric power release current can be caused to simultaneously flow in any operation situation of the plurality of elementary drivers 21, for example, when first, second and fourth elementary drives carries out the electric power recovery operation, but third, fifth and succeeding drives carries out the electric power release operation. In other words, the recovery of the recovery current to the capacitor $C_{21}$ through the common line $W_{21}$ and the coil $L_{21}$ and the release of the release current from the capacitor $C_{21}$ through the coil $L_{22}$ and the common line $W_{22}$, can be executed simultaneously, so that a simultaneous mixed operation of the electric power recovery and release can be realized.

Figure 5:
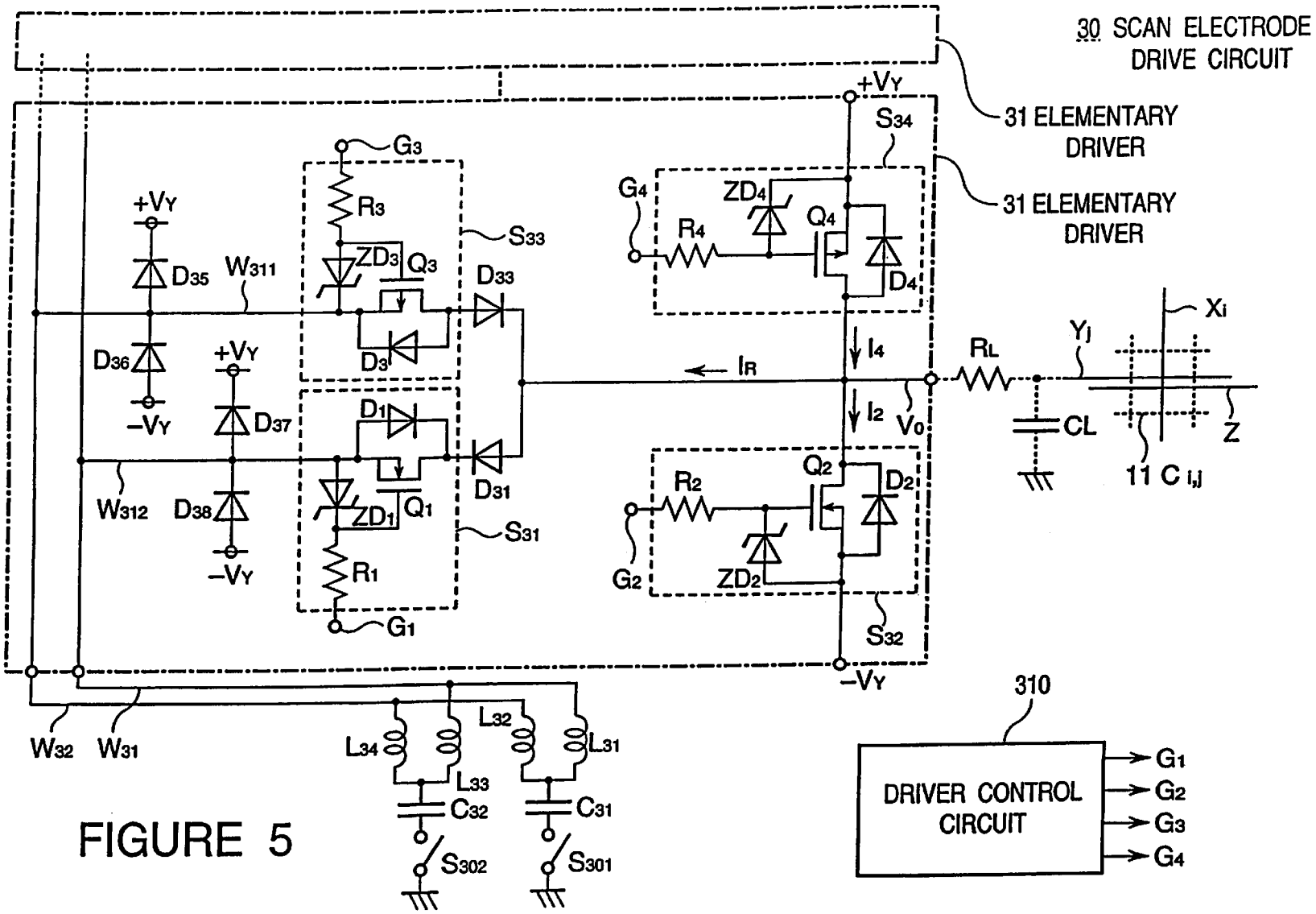
FIG. 5 is a circuit diagram of a scan electrode driving circuit in the display panel drive circuit shown in FIG. 3.

Now, referring to FIG. 5, there is shown a circuit diagram of the scan electrode driving circuit 30 in the display panel drive circuit shown in FIG. 3. The scan electrode driving circuit 30 includes a plurality of elementary drivers 31, only one of which is shown in detail since the elementary drivers 31 have the same construction.

The scan electrode driving circuit 30 is basically different from the date electrode driving circuit 20, in that the scan electrode driving circuit 30 handles the sustain pulse, which consumes a maximum electric power in the display panel drive circuit. In addition, the scan pulse supplied to the same scan electrode Yj is different in magnitude between a write pulse voltage Vw applied in the data write period and a sustain pulse voltage Vs applied in the sustain discharge period. Therefore, the scan electrode driving circuit 30 includes a first group switch $S_{301}$ closed during the data write period, a first group capacitor $C_{31}$, a pair of first group coils $L_{31}$ and $L_{32}$, as well as a second group switch $S_{302}$ closed during the sustain discharge period, a second group capacitor $C_{32}$, a pair of second group coils $L_{33}$ and $L_{34}$. Furthermore, the scan electrode driving circuit 30 includes an electric power recovery common line $W_{31}$ connected to the coils $L_{31}$ and $L_{33}$, and an electric power release common line $W_{32}$ connected to the coils $L_{32}$ and $L_{34}$.

Since each elementary driver 31 has the same construction as that of the elementary driver 21 of the data electrode drive circuit 20, elements of the elementary driver 31 are given the Reference Signs obtained by replacing the suffix of Reference Signs shown in FIG. 4 by numbers on the level of 30, namely, by adding 10 to the suffix of Reference Signs shown in FIG. 4. More specifically, the switches $S_{31}$ and $S_{32}$ includes NMOS transistors $Q_1$ and $Q_2$, respectively, which have a gate connected to receive control signals $G_1$ and $G_2$ through an associated resistor $R_1$ and $R_2$, respectively. The switches $S_{33}$ and $S_{34}$ includes PMOS transistors $Q_3$ and $Q_4$, respectively, which have a gate connected to receive control signals $G_3$ and $G_4$ through an associated resistor $R_3$ and $R_4$, respectively. A protection diode $D_1$, $D_2$, $D_3$ and $D_4$ for allowing a reverse current are connected in parallel to the transistors $Q_1$, $Q_2$, $Q_3$ and $Q_4$, respectively, and protection Zener diodes $ZD_1$, $ZD_2$, $ZD_3$ and $ZD_4$ are connected between a gate and a source of the transistors $Q_1$, $Q_2$, $Q_3$ and $Q_4$, respectively. Therefore, the switches $S_{21}$ to $S_{24}$ of the elementary driver 21 of the data electrode drive circuit 20 can be constituted similarly to the switches $S_{31}$ to $S_{34}$ of the elementary driver 31.

An electric power release line $W_{311}$ connected to the switch $S_{33}$ in each elementary driver 31, is connected to an anode of a protection diode $D_{35}$ having a cathode connected to the high potential power supply $+V_Y$ and to a cathode of another protection diode $D_{36}$ having an anode connected to the low potential power supply $-V_Y$, and is further concentrated and connected to the electric power release common line $W_{32}$. An electric power recovery line $W_{312}$ connected to the switch $S_{31}$ in each elementary driver 31, is connected to an anode of a protection diode $D_{37}$ having a cathode connected to the high potential power supply $+V_Y$ and to a cathode of another protection diode $D_{38}$ having an anode connected to the low potential power supply $-V_Y$, and is further concentrated and connected to the electric power recovery common line $W_{31}$.

Furthermore, the scan electrode driving circuit 30 includes a driver control circuit 310 for generating the control signals $G_1$ to $G_4$ for each of all the elementary drivers 31 corresponding to all the scan electrodes $Y_1$ to Ym.

If a capacitance of each of the capacitors $C_{31}$ and $C_{32}$ is set to be one hundred times to one thousand times of the load capacitance when the display panel is driven, almost no voltage variation occurs at the time of recovering and re-using (releasing) the electric power. At this time, a voltage across the capacitors is stable at a voltage which is about a half of the drive pulse applied to the electrode. For example, the voltage across the capacitor $C_{31}$ becomes about Vw/2. In addition, the inductance of the coils are set to ensure that a transfer of the electric charge is completed during the respective closed period of the associated switches $S_{301}$ and $S_{302}$.

Incidentally, a load capacitance associated with the scan electrode Yj is represented by a capacitor CL in FIG. 5.

Now, the electric power recovery operation and the electric power release operation of the shown embodiment will be described with reference to FIG. 5 and FIG. 6 which is a timing chart illustrating an operation of the display panel drive circuit in accordance with the present invention. In the following description, the elementary driver 31 connected to the scan electrode Yj is explained as a representative example, further with reference to FIG. 3.

As shown in FIG. 3, the ground potential is supplied as the $+V_Y$ in all of the pre-discharge period, the data write period and and the sustain discharge period. On the other hand, in the pre-discharge period, a switch $P_{Y1}$ is closed and switches $P_{Y2}$ and $P_{Y3}$ are open, so that a negative erase pulse Vap is supplied as the $-V_Y$. In the data write period, the switch $P_{Y2}$ is closed and switches $P_{Y1}$ and $P_{Y3}$ are open, so that the write scan pulse voltage Vw is supplied as the $-V_Y$, and in the sustain discharge period, the switch $P_{Y3}$ is closed and switches $P_{Y1}$ and $P_{Y2}$ are open, so that the sustain pulse voltage Vs is supplied as the $-V_Y$.

In the data write period, the switch $S_{301}$ is closed and the switch $S_{302}$ is open. At a starting time of the data write period where the scan pulse is outputted to the scan electrode Yj, the switch $S_{34}$ is closed, but all the switches $S_{31}$, $S_{32}$ and $S_{33}$ are open, so that the output voltage Vo supplied to the scan electrode Yj is $+V_Y$ which is the ground level GND as shown in FIG. 3.

In this condition, if the switch $S_{34}$ is opened and the switch $S_{31}$ is closed (switch condition "1"), a current $I_R$ flows from the load capacitance CL through the closed first group switch $S_{301}$ and the first group coil $L_{31}$ to the first group capacitor $C_{31}$, a potential across which is about Vw/2, so that an electric power recovery operation is conducted. After a peak of the current $I_R$, the current $I_R$ continues to flow by action of the inductance of the coil $L_{31}$, so that the output voltage Vo changes toward the level of the voltage Vw. However, because of a power consumption by a resistive component $R_L$ of the current path, the output voltage Vo does not completely drop to the level of the voltage Vw. A vibration in the operation of the electric power recovery to the capacitor $C_{31}$ is blocked by the diode $D_{31}$ and is terminated with a recovery efficiency which is a ratio of a final reaching potential to the Vw level. Here, the diodes $D_{35}$ to $D_{38}$ protect the associated semiconductor devices from being broken by an electromotive voltage of the inductance action of the coils $L_{31}$ to $L_{34}$. In the case that the reaching potential due to the electric power recovery exceeds a threshold potential of a discharge generation, it is necessary to put forward the operating timing of the switches $S_{31}$ and $S_{32}$ so as to ensure that the reaching potential due to the electric power recovery in no way exceeds the threshold potential of the discharge generation, for the purpose of preventing an erroneous display attributable to generation of an incomplete discharge. To the contrary, if the reaching potential due to the electric power recovery does not exceed the threshold potential of the discharge generation, even if the closed period of the switch $S_{31}$ has a marginal time, since the reverse current of $I_R$ is blocked by the diode $D_{31}$, the output voltage Vo is maintained until the next change of the switches.

In a next switch condition "2", the switch $S_{31}$ is opened and the switch $S_{32}$ connected to the low potential power supply $-V_Y$, is closed to cause the output voltage Vo to drop to and converge on the voltage Vw. A current $I_2$ composed of this converging operation current and a data write current occurring after a time Tw from the time when the output voltage has reached the voltage Vw, flows through the switch $S_{32}$, and therefore, results in an electric power consumption.

In a switch condition "3" after a predetermined pulse width period, the switch $S_{32}$ is opened and the switch $S_{33}$ is closed, so that the current $I_R$ flows towards the load capacitance CL through the switch $S_{301}$ and the coil $L_{32}$ from the capacitor $C_{31}$ which is at about Vw/2. Namely, the electric power stored in the capacitor $C_{31}$ is released. Thus, the output voltage Vo changes toward to the ground level GND, in an operation similar to the electric power recovery operation as mentioned above other than the direction of the current. However, since the output voltage Vo does not completely reach the ground level GND because of the electric power consumption of the resistive component $R_L$ of the current path, similarly to the electric power recovery operation. Therefore, in a next switch condition "4", the switch $S_{33}$ is opened and the switch $S_{34}$ connected to the high potential power supply $+V_Y$ (namely, the ground level GND) is closed to cause the output voltage Vo to pull up to and converge on the ground level GND, by means of a current $I_4$.

If the above mentioned scan pulse driving for the scan pulse electrode Yj is completed, a similar scan pulse driving is conducted for a next scan pulse electrode Yj+1.

Next, the sustain pulse outputting operation in the sustain discharge period will be described. The sustain pulse voltage Vs supplied in this sustain discharge period is different from the write scan pulse voltage Vw applied in the data write period, and therefore, in order to recover the sustain pulse voltage Vs with the second group capacitor $C_{32}$, the switch $S_{301}$ is open and the switch $S_{302}$ is closed. The driving with the sustain pulse voltage Vs is so conducted that all the scan electrodes are driven in parallel and therefore are put into the same condition at any time, and on the other hand, the electric power recovery operation and the electric power release operation are conducted in a time-division manner, with the result that all the elementary drivers 31 repeat the same operation at the same timing. Accordingly, the operation of the switches $S_{31}$ to $S_{34}$ and a detailed operation of the electric power recovery operation and the electric power release operation are the same as those in the data write period, excepting that the voltage Vs is supplied as the $-V_Y$ in place of Vw, and therefore, explanation thereof will be omitted.

In addition, since a total load capacitance is large in correspondence to the number of the scan electrodes driven in parallel, a required capacitance of the second group capacitor $C_{32}$ is large in comparison with that of the capacitor $C_{31}$ for the write scan pulse.

Figure 6:
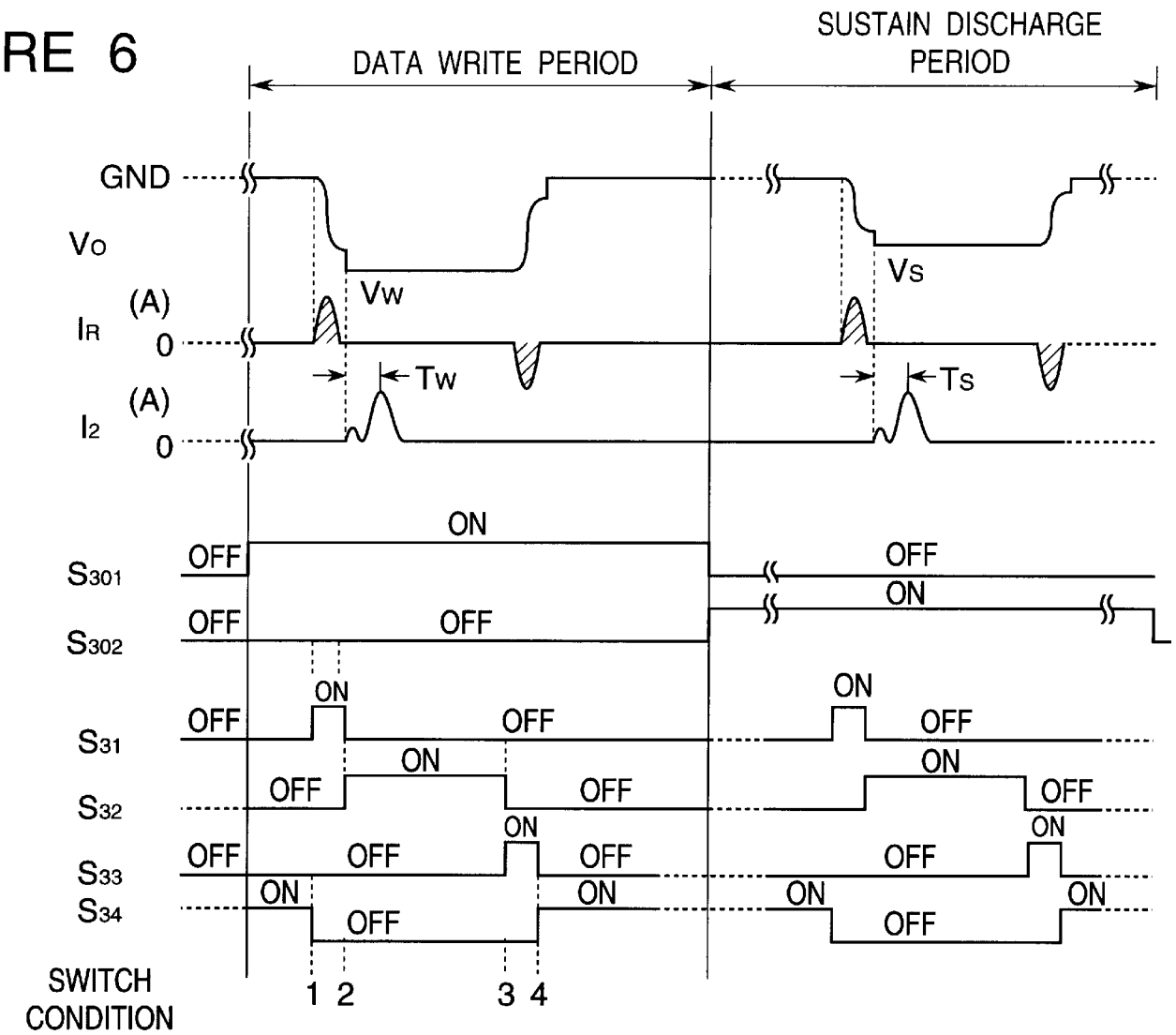
FIG. 6 is a timing chart illustrating an operation of the display panel drive circuit in accordance with the present invention.

Although it is omitted in FIG. 6, the on-off operation of the switches $S_{21}$ to $S_{24}$ in the elementary driver 21 of the data electrode drive circuit 20 is the same as that of the switches $S_{31}$ to $S_{34}$ in the elementary driver 31 of the scan electrode drive circuit 30, excepting that the data pulse voltage Vd is a single level and therefore only one electric power recovery capacitor $C_{21}$ is provided and a switch for selecting the electric power recovery capacitor is not required.

In addition, the driving of the data pulse is similar to the driving of the scan pulse in the point that the electrodes are individually driven, but different from the driving of the scan pulse in the point that an indefinite number of electrodes are driven with an indefinite pulse width, since the elementary driver 21 drives the corresponding data electrode on the basis of a display data. In addition, the sequential on-off operation of the switches $S_{21}$ to $S_{24}$ requires a control having no substantial loss time, without using the time division, because the high speed data display is required.

Next, there will be described a construction and a control method of the driver control circuit for controlling the switches $S_{21}$ to $S_{24}$ and the switches $S_{31}$ to $S_{34}$ of all the elementary drivers 21 and 31 in order to realize the data pulse driving, the scan pulse driving and the sustain pulse driving of the elementary drivers.

Figure 7:
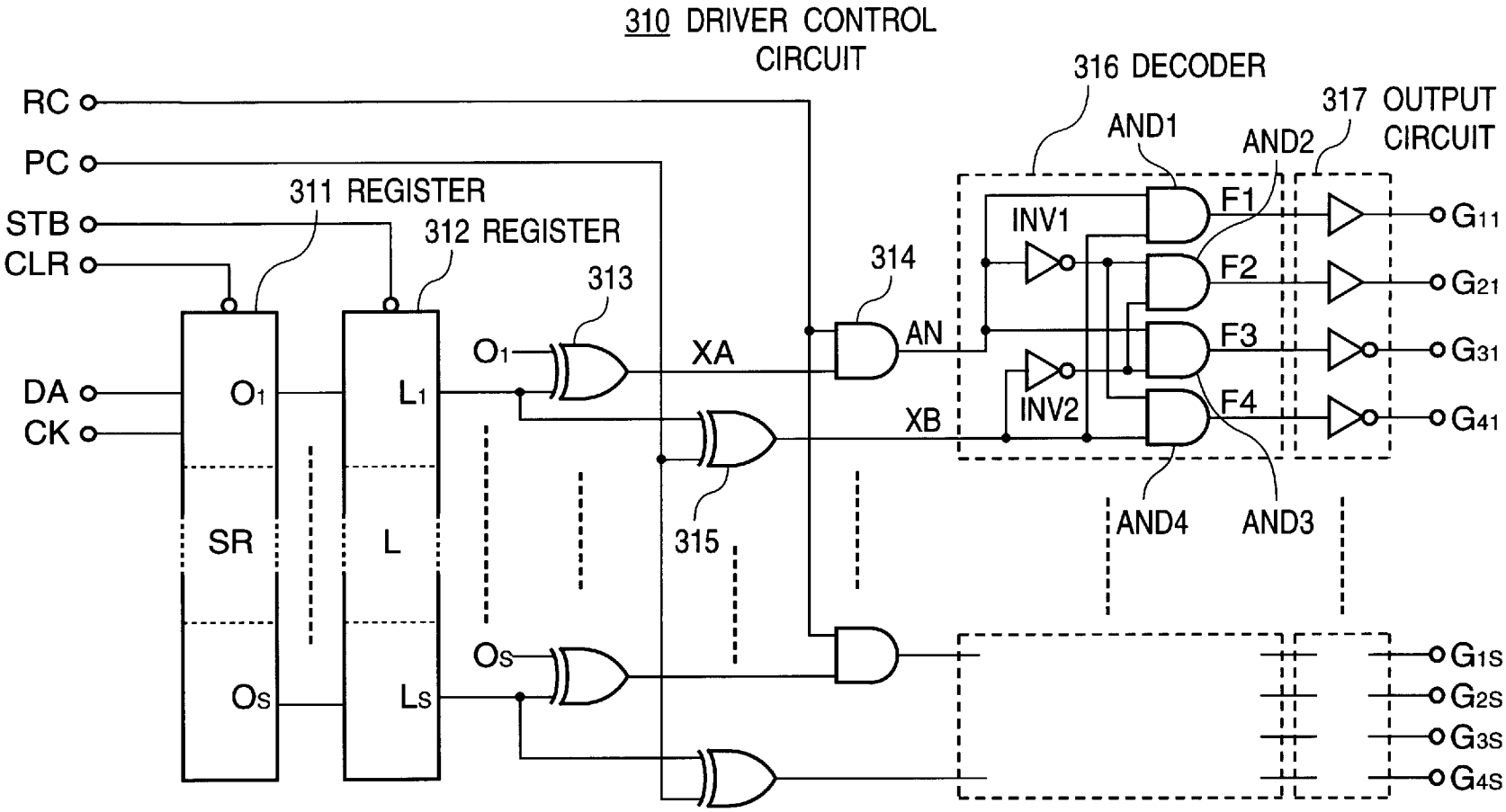
FIG. 7 is a block diagram of the driver control circuit used in the display panel drive circuit in accordance with the present invention.

Referring to FIG. 7, there is shown a block diagram of a part of the driver control circuit 310 used in the display panel drive circuit in accordance with the present invention.

The shown driver control circuit 310 includes a "s"-stage shift register 311 "SR" cleared in response to a clear signal CLR and serially receiving a drive data DA in synchronism with a clock CK and having an "s" outputs $O_1$ to Os which are simply represented by "O" hereinafter, case by case, and a register 312 "L" composed of "s" latch circuits latching the outputs $O_1$ to Os of the shift register 311 in response to a pulse STB and outputting, in parallel, the latched data $L_1$ to Ls which are simply represented by "L" hereinafter, case by case.

The shown driver control circuit 310 also includes "s" exclusive-OR gates 313 (detector) each receiving one output O (for example $O_1$) of the shift register 311 and a corresponding output L (for example $L_1$) of the register 312, for detecting a logical transition of the corresponding driving data so as to output a transition detection signal XA, "s" two-input AND gates 314 each receiving a corresponding detection signal XA and a recovery/release control pulse RC, for outputting a logical product signal AN, and "s" exclusive-OR gates 315 each receiving one output L of the register 312 and a polarity control signal PC, for generating a logical signal BN.

Furthermore, the shown driver control circuit 310 includes "s" decoders 316 each receiving one logical product signal AN and a corresponding logical signal XB, for outputting four control original signals $F_1$ to $F_4$ each having a logical level corresponding to the switch conditions "1" to "4" of the switches $S_{31}$ to $S_{34}$ of a corresponding elementary driver, and "s" output circuits 317 receiving the control original signals F1 to F4, respectively, to level-convert the received signals so as to generate the control signals $G_1$ to $G_4$, respectively. Each of the output circuits 317 is composed of a CMOS transistor circuit having a high breakdown voltage.

More specifically, each of the decoders 316 includes a first AND gate AND1 directly receiving the logical product signal AN and the logical signal XB, for generating the control original signal F1, a second AND gate AND2 receiving the logical product signal AN through an inverter INV1 and the logical signal XB through another inverter INV2, for generating the control original signal F2, a third AND gate AND3 receiving the logical product signal AN directly and the logical signal XB through the inverter INV2, for generating the control original signal F3, and a fourth AND gate AND4 receiving the logical product signal AN through the inverter INV1 and the logical signal XB directly, for generating the control original signal F4.

In the case that the whole of a display panel having a number of electrodes in a display cell matrix, is constructed integrally, it is a conventional practice that an input register is composed of a shift register in order to reduce the number of input lines of the driving data. The shown embodiment includes the "s"-stage shifter register 311 corresponding to "s" elementary drivers 31. As mentioned above, this shift register 311 is cleared in response to the clear signal CLR, and in synchronism with the clock, the drive data DA is inputted into the shift register 312 and the content of each stage of the shift register 312 is shifted to a next stage of the shift register 312. The contents of the respective stages of the shift register 311 are latched as the outputs 0 I to Os to the "s" latch circuit of the register 312 in response to the pulse STB.

As mentioned above, the "s" elementary drivers 31 and one driver control circuit 310 are integrated as one unit to constitute an electrode driver for the display panel. Here, the numbers "s" and "m" have such a relation that "m" is equal to or smaller than a multiple of "s".For example, assuming that "s" is 40 and "m" is 480, 12 units each composed of 40 elementary drivers 31 and one driver control circuit 310 are used for driving 480 scan electrodes of the display panel.

Now, an operation of the driver control circuit 310 will be described with reference to FIG. 7 and FIG. 8 which is a timing chart illustrating various waveforms, enlarged in part, in the case that the driving of the scan pulse during the data write period and the driving of the sustain pulse during the sustain discharge period are controlled by the same circuit.

Figure 8:
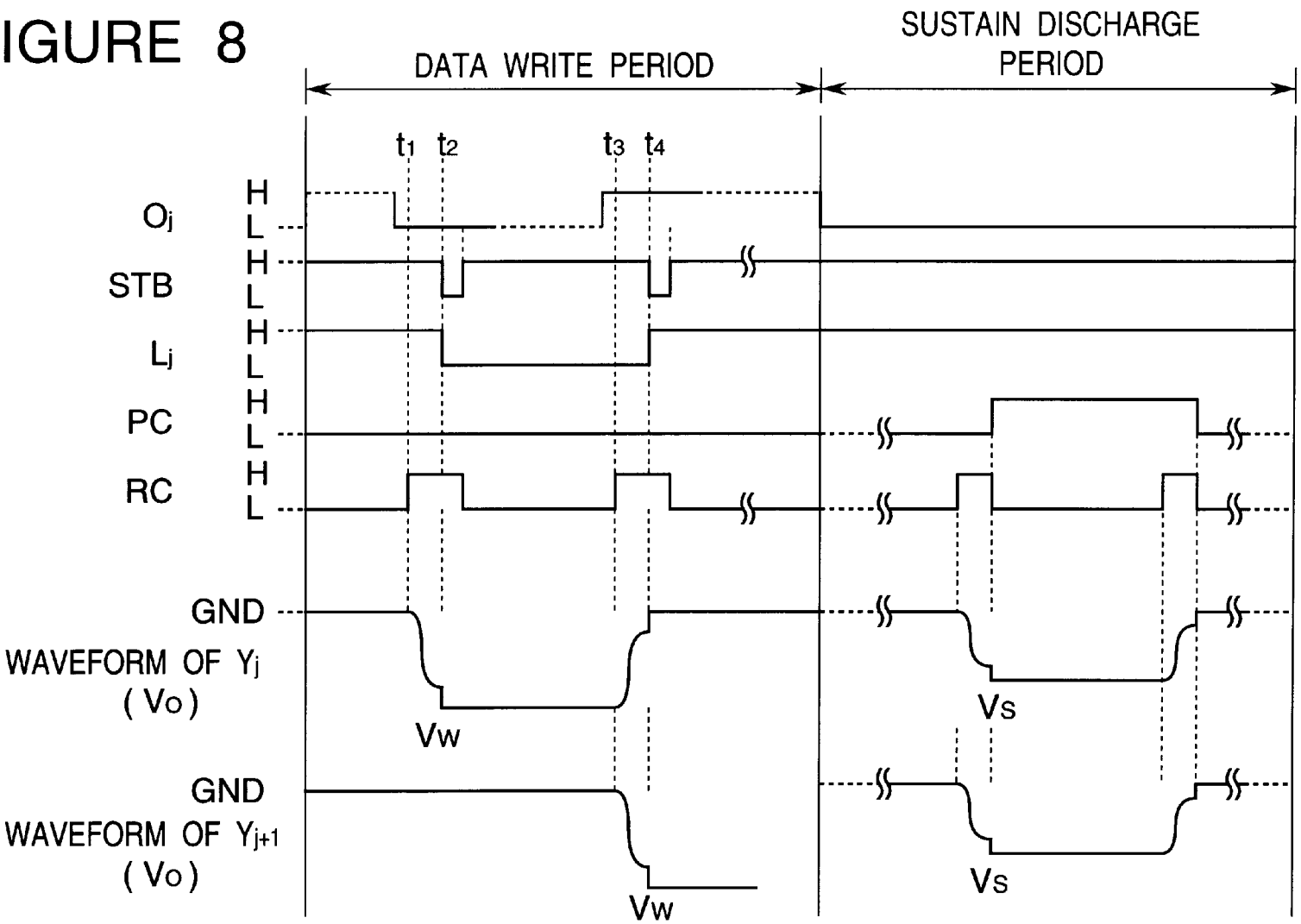
FIG. 8 is a timing chart illustrating an operation of the driver control circuit for the scan electrode drive circuit in the display panel drive circuit in accordance with the present invention.

During the data write period, the pulse STB and the pulse RC are repeated at internals as shown in FIG. 8, respectively. A data transfer timing in response to the clock CK is set before a rising time $t_1$ of the pulse RC. The pulse PC is set to a logical low level L, and the pulse CLR is set to an inactive logical high level H (not shown).

Here, assume that the scan data DA having an active low level L of a one-clock width is transferred from the output Oj of the shift register 311 in response to one clock CK. This becomes inconsistent with a logical high level H of the output Lj of the register (latch circuit) 312 which holds the data before one scan, so that the output signal XAj of the exclusive-OR gate 313 is brought to the logical high level H. Thereafter, if the pulse RC is brought to the high level H at the timing $t_1$, the output of the AND gate 314 is brought to the high level H. On the other hand, since both the signal Lj and the output signal XBj of the exclusive-OR gate 315 are at the logical high level H, the output F of the decoder 316 brings the signal $G_1$ to the logical high level H so that only the switch $S_{31}j$ is closed, namely, the switch condition "1" is realized. Accordingly, the electric power recover is conducted for the electrode Yj, and the drive output voltage Vo goes to the level of the voltage Vw. Here, the signal Oj and the pulse RC are maintained as they are, until the electric power recovery is completed.

Next, at a timing $t_2$, the pulse STB is brought to an active low level L, so that the signal Oj is latched to the latch circuit 312. As a result, the signals Lj and Oj become consistent, so that the signal XAj is brought to the logical low level L, and therefore, the signal AN is also brought to the logical low level L. On the other hand, since both the signals Lj and the signal XBj are brought to the logical low level L, the output F of the decoder 316 brings the signal $G_2$ to the logical high level H so that only the switch $S_{32}j$ is closed, namely, the switch condition "2" is realized.

After the pulse STB is brought to the active low level L, the pulse RC is brought to the low level L, so as to release the holding of the scan data DA.

In the driving with a predetermined pulse width of the voltage Vw, the scan data DA is transferred in the shift register in response to the clock CK so that the active logical low level L is shifted to the output $Oj+_1$, and the logical high level H is shifted to the output Oj. At this time, the output Oj becomes inconsistent with the signal Lj of the register 312, so that the signal XAj is brought to the logical high level. If the pulse RC is brought to the logical high level H at a timing $t_3$, the signal AN is also brought to the logical high level H. On the other hand, since both the signal Lj and the signal XBj are at the logical low level L, the output F of the decoder 316 brings the signal $G_3$ to the logical low level L so that only the switch $S_{33}j$ is closed, namely, the switch condition "3" is realized. Thus, the electric power is released toward the electrode Yj, and the drive output voltage Vo goes toward the ground level GND. Simultaneously, the switch condition "1" is realized for the electrode $Yj+_1$.

At a timing t4, the signal Oj is latched in the latch circuit 312 in synchronism with the pulse STB. As a result, the signals Lj and Oj become consistent with each other, so that the signal XA is brought to the logical low level L, and therefore, the output of the AND gate 314 is also brought to the logical low level L. On the other hand, each of the signals Lj and XBj is brought to the logical high level H. Accordingly, the output F of the decoder 316 brings the signal $G_4$ to the logical low level L so that only the switch S34j is closed, namely, the switch condition "4" is realized.

Thus, one sequential driving operation for the electrode Yj is completed. Simultaneously, the switch condition "2" is realized for the electrode Yj+1, and therefore, the scan pulse can be sequentially shifted to a next electrode without a substantial loss time.

Accordingly, the feature of the present invention can be found in a relation between the signal Lj and the driving output voltage waveform. First, prior to a transition of the signal Lj, the electric power recover/release is conducted in an active logical level period of the recovery/release control pulse. Secondly, a difference between the output voltage waveform and the signal Lj corresponds to one operation period of the electric power recovery or release. Thirdly, this operation period of the electric power recovery or release can be controlled by changing the transition of the recovery/release control pulse RC going to the logical high level, and the transition of the pulse STB.

For convenience, the electric power recovery/release operation is conducted during a logical high level period of the pulse RC. The logic polarity relation is the same between the input and the output. However, it would be apparent to persons skilled in the art that the logic polarity relation can be opposite between the input and the output, within the spirit of the present invention and within the scope of the appending claims.

Next, the driving of the sustain pulse during the sustain discharge period will be described. In this connection, in order to perform the driving of the sustain pulse, it may be considered to designate all the outputs at an input of the drive data DA. In this embodiment, however, a simple control is realized by adding the polarity control signal PC to the recovery/release control pulse RC.

First, in order to set the sustain discharge period, all the outputs $L_1$ to Ls of the latch circuit 312 are brought to the logical high level H, and the pulse STB is set to the inactive logical high level H. In addition, the clear pulse CLR is brought to the active logical low level L, so that all the outputs $O_1$ to Os of the shift register 311 are fixed to the logical low level L. With this setting, the output XA of all the exclusive-OR gates 313 included in the driver control circuit 310 are fixed to the logical high level H, and therefore, the output AN of the AND gates 314 ceaselessly have the same logic level as that of the pulse RC, and on the other hand, the output XB of the exclusive-OR gates 315 ceaselessly have the logic level opposite to that of the pulse PC.

After this setting, the driving of the sustain pulse is started. First, the pulse PC is brought to the logical low level L and the pulse RC is brought to the logical high level H. Therefore, the output F of the decoder 316 brings the signal $G_1$ to the logical high level H so that only the switch $S_{31}j$ is closed, namely, the switch condition "1" is realized. Accordingly, the electric power is recovered from the electrode Yj, and the driving output voltage Vo goes toward the voltage Vs.

Then, the pulse PC is brought to the logical high level H and the pulse RC is brought to the logical low level L. Therefore, the output F of the decoder 316 brings the signal $G_2$ to the logical high level H so that only the switch $S_{32}j$ is closed, namely, the switch condition "2" is realized.

After a period corresponding to a predetermined pulse width, the pulse PC is brought to the logical high level H and the pulse RC is also brought to the logical high level H. Therefore, the output F of the decoder 316 brings the signal $G_3$ to the logical low level L so that only the switch $S_{33}j$ is closed, namely, the switch condition "3" is realized. Accordingly, the electric power is released toward the electrode Yj, and the driving output voltage Vo goes toward the ground level GND.

As a final operation of a series of sequential operations, the pulse PC is brought to the logical low level L and the pulse RC is also brought to the logical low level L. Therefore, the output F of the decoder 316 brings the signal $G_4$ to the logical low level L so that only the switch $S_{34}j$ is closed, namely, the switch condition "4" is realized. In other words, the condition returns to an initial condition.

Thus, the sustain pulse driving can be simply performed by repeating the above mentioned series of time-division operations.

The driver control circuit 210 of the data electrode drive circuit 20 can be constituted similarly to the driver control circuit 310 shown in FIG. 7. In other words, the driver control circuit 310 shown in FIG. 7 can be considered to be the driver control circuit 210 of the data electrode drive circuit 20.

Therefore, a control operation of the driver control circuit 210 of the data electrode drive circuit 20 will be described with reference to FIG. 9, which is a timing chart illustrating an operation of the driver control circuit for the data electrode drive circuit, and with reference to FIG. 7 by replacing the Reference Numerals on the level of 300 by corresponding Reference Numerals on the level of 200, or by subtracting "100" from the Reference Numerals. In this case, furthermore, the numbers "s" and "n" have such a relation that "n" is equal to or smaller than a multiple of "s".

During the data pulse driving period, the pulse STB and the pulse RC are repeated with intervals as shown, respectively, similarly to the scan pulse driving period. A data transfer performed in response to the clock CK is completed before a rising time $t_1$ of the pulse RC. The pulse PC is set to a logical low level L, and the pulse CLR is set to an inactive logical high level H (not shown).

This data pulse driving is different from the scan pulse driving as mentioned hereinbefore in that, since the data DA supplied to the shift register 211 is indefinite, the same logical polarity often continues.

Figure 9:
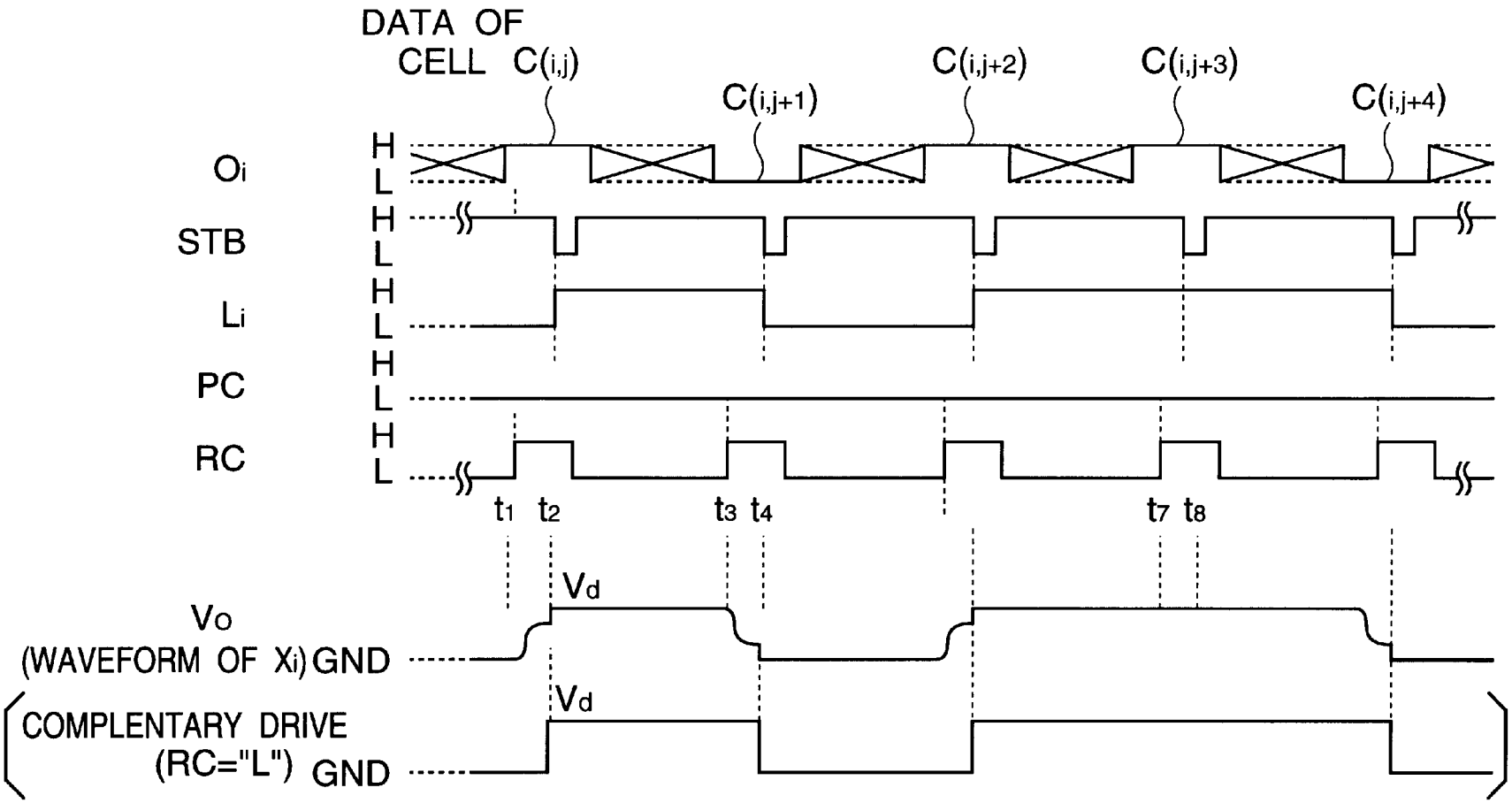
FIG. 9 is a timing chart illustrating an operation of the driver control circuit for the data electrode drive circuit in the display panel drive circuit in accordance with the present invention.

Here, if the data for the display cell Cij and succeeding cells are transferred to the outputs Oj of the shifter register 211, the output signals Li of the register 212 appear as a data pattern shown in FIG. 9, so that a corresponding (i)th elementary driver 21 constitutes a drive output signal Xi.

For convenience of description, the operation will be described from a timing $t_7$, namely, from the logical high level condition of the cell $C_{i,j+3}$ following the logical high level condition of the cell $C_{i,j+2}$. At the data driving of the cell $C_{i,j+3}$ at the timing $t_7$, both the signal Oi of the register 211 and the output signal Li of the register 212 are at the logical high level, and therefore, no level transition occurs. Therefore, the output signal XA of the exclusive-OR gate 213 is at the logical low level L, so that the pulse RC is blocked by the AND gate 214, and accordingly, the output signal AN of the AND gate 214 is maintained at the logical low level. On the other hand, since both the signal Li and the output signal XB of the exclusive-OR gate 215 are at the logical high level, no level transition occurs. Thus, the output F of the decoder 216 maintains the signal G4 at the logical low level L so that the switch condition "4" closing only the switch $S_{31}j$ is maintained. Accordingly, the (i)th elementary driver 21 continues to output the voltage Vd. At a timing $t_8$, both the signals Oi and Li are at the logical high level H, and therefore, no level transition occurs, so that the (i)th elementary driver 21 continues to output the voltage Vd.

As mentioned above, if the same logical polarity continues in the data DA, the driving output voltage continues to maintain the same voltage. Therefore, if no logic level transition occurs in the data, no electric power recovery/release operation is carried out.

Incidentally, by setting the recovery/release control pulse RC at the logical low level L, the driving voltage becomes a voltage waveform of a conventional complementary operation as shown at the bottom in FIG. 9. Therefore, it is possible to alternatively select the electric power recovery/release operation and the conventional complementary operation.

As seen from the above, the display panel driving circuit in accordance with the present invention comprises:

a plurality of elementary driver circuits each provided for each one of the drive electrodes, each including a first switch on-off controlled to recover a recovery current from a corresponding drive electrode to an electric power recovery line, a second switch on-off controlled to selectively connect the corresponding drive electrode to a low potential power supply line, a third switch on-off controlled to supplying a recovered electric current from an electric power release line to the corresponding drive electrode, and a fourth on-off controlled to selectively connect a high potential power supply line to the corresponding drive electrode;

an electric power recovery common line;

an electric power release common line;

first and second inductors having one end thereof connected to the electric power recovery common line and the electric power release common line, respectively;

a capacitor having one end connected in common to the other end of the first and second inductors; and a driver control circuit for supplying switch control signals to the first to fourth switches of each of the plurality of elementary driver circuits, so that each of the elementary driver circuits can perform the electric power recovery operation and the electric power release operation simultaneously in parallel to those of the other elementary driver circuits.

Therefore, the electric power recovery/release can be carried out not only in the display cell sustain discharge driving period but also in the display data writing period. Accordingly, the electric power consumption can be remarkably reduced. In addition, the display panel driving circuit in accordance with the present invention is simple in construction and easy in control, and therefore, is very excellent in practical use.

The invention has thus been shown and described with reference to the specific embodiments. However, it should be noted that the present invention is in no way limited to the details of the illustrated structures but changes and modifications may be made within the scope of the appended claims.

I claim:

1. A circuit for driving a display panel which includes a number of display cells located in the form of a matrix and comprises a plurality of drive electrodes which are independent of one another and which constitute a capacitive load, said driving circuit being configured to drive each of said plurality of drive electrodes by an AC drive pulse and to recover a reactive electric power attributable to said capacitive load so as to supply said recovered electric power together with a next drive pulse, for the purpose of improving a driving efficiency, said driving circuit comprising:

a plurality of elementary driver circuits each provided for each one of said drive electrodes, each including:

a first switch connected between a corresponding one of said drive electrodes and an electric power recovery line, and on-off controlled to recover from said corresponding drive electrode a recovery current corresponding to said reactive electric power;

a second switch connected between said corresponding drive electrode and a low potential power supply line, and on-off controlled to selectively connect said low potential power supply line;

a third switch connected between said corresponding drive electrode and an electric power release line, and on-off controlled to supplying a recovered electric current to said corresponding drive electrode; and a fourth switch connected between said corresponding drive electrode and a high potential power supply line, and on-off controlled to selectively connect said high potential power supply line to said corresponding drive electrode;

a first common line connected in common to said electric power recovery line of said plurality of elementary driver circuits;

a second common line connected in common to said electric power release line of said plurality of elementary driver circuits;

first and second inductors having one end thereof connected to said first and second common lines respectively;

a first capacitor having one end connected in common to the other end of said first and second inductors and the other end connected to a predetermined potential; and a driver control circuit for supplying switch control signals to said first to fourth switches of each of said plurality of elementary driver circuits;

wherein said driver control circuit comprises:

a first register composed of an "s"-stage shift register serially receiving a driving data signal in synchronism with a clock signal, for output a first register signal of "s" bits in parallel, where "s" is integer larger than one;

a second register composed of"s" latch circuits, for latching, in parallel, said "s" bits of said first register signal from said first register in response to a latch control signal, and for outputting a second register signal of"s" bits;

"s" exclusive-OR gates each receiving a pair of mutually corresponding bits of said first and second register signals, for detecting a logical transition in said driving data signal, to generate a transition detection signal;

"s" logic circuits each receiving recovery/release control signal and said transition detection signal of a corresponding exclusive-OR gate of said "s" exclusive-OR gates, for generating a first control pulse; and "s" decoders each receiving said first control pulse of a corresponding logic circuit of said "s" logic circuits and a corresponding bit of said second register signal, for generating first to fourth on-off control signals for said first to fourth switches of a corresponding elementary driver circuit of said elementary driver circuits of said driver control circuit.

2. A display panel driving circuit claimed in claim 1 wherein, during a period in which said recovery/release control signal is at an active level, said driver control circuit prevents said first register signal from being latched to said second register, and after an elapse of a predetermined time period from execution of each of the electric power recovery operation and the electric power release operation, said driver control circuit causes said second register to latch said first register signal, so that when no logical level transition occurs in said drive data signal, neither the electric power recovery operation or the electric power release operation is carried out.

3. A display panel driving circuit claimed in claim 1 wherein wherein said driver control circuit further includes "s" second exclusive-OR gates each receiving a polarity control signal and a corresponding bit of said second register signal, for generating a second control pulse, and each of said "s" decoders receives said first control pulse of said corresponding logic circuit of said "s" logic circuits and said second control pulse of a corresponding second exclusive-OR gate of said "s" second exclusive-OR gates, so that all of said elementary driver circuits are caused to carry out the same operation in parallel by controlling said polarity control signal.

4. A circuit for driving a display panel which includes a number of display cells located in the form of a matrix and comprises a plurality of drive electrodes which are independent of one another and which constitute a capacitive load, said driving circuit being configured to drive each of said plurality of drive electrodes by an AC drive pulse and to recover a reactive electric power attributable to said capacitive load so as to supply said recovered electric power together with a next drive pulse for the purpose of improving a driving efficiency, said driving circuit comprising:

a plurality of elementary driver circuits each provided for each one of said drive electrodes each including:

a first switch connected between a corresponding one of said drive electrodes and an electric power recovery line, and on-off controlled to recover from said corresponding drive electrode a recovery current corresponding to said reactive electric power;

a second switch connected between said corresponding drive electrode and a low potential power supply line, and on-off controlled to selectively connect said low potential power supply line;

a third switch connected between said corresponding drive electrode and an electric power release line, and on-off controlled to supplying a recovered electric current to said corresponding drive electrode; and a fourth switch connected between said corresponding drive electrode and a high potential power supply line, and on-off controlled to selectively connect said high potential power supply line to said corresponding drive electrode;

a first common line connected in common to said electric power recovery line of said plurality of elementary driver circuits; a second common line connected in common to said electric power release line of said plurality of elementary driver circuits;

first and second inductors having one end thereof connected to said first and second common lines, respectively;

a first capacitor having one end connected in common to the other end of said first and second inductors and the other end connected to a predetermined potential;

a driver control circuit for supplying switch control signals to said first to fourth switches of each of said plurality of elementary driver circuits;

wherein said display panel is an AC drive type plasma display panel which includes a number of display cells located in the form of a matrix, a plurality of mutually independent data electrodes arranged along a plurality of columns of said matrix of said display cells, and a plurality of mutually independent scan electrodes arranged along a plurality of rows of said matrix of said display cells, and wherein the display panel driving circuit includes a data electrode drive circuit for supplying a data drive pulse to each of said data electrodes and a scan electrode drive circuit for supplying a scan drive pulse to each of said scan electrodes, said data electrode drive circuit including;

said elementary drive circuits of a first number, each provided for each one of said data electrodes for responding to first driver control signals to supply a data electrode drive voltage to a corresponding data electrode independently of the other data electrodes and carry out an electric power recovery and release operation for said corresponding data electrode independently of the other data electrodes;

said first common line and said second common line connected in common to said electric power recovery line and said electric power release line of said elementary driver circuits respectively;

said first and second inductors having one end thereof connected to said first and said common lines, respectively;

said first capacitor having one end connected in common to the other end of said first and second inductors and the other end connected to said predetermined potential; and a first driver control circuit for generating said first driver control signals in response to an input data signal, said scan electrode drive circuit including;

elementary driver circuits of a second number, each provided for each one of said scan electrodes, for responding to second driver control signals to supply a scan electrode drive voltage to a corresponding scan electrode independently of the other scan electrodes, and carry out the electric power recovery and release operation for said corresponding scan electrode; independently of the other scan electrodes;

a third common line and a fourth common line connected in common to said electric power recovery line and said electric power release line of said elementary driver circuits, respectively, of said scan electrode drive circuit;

third and fifth inductors each having one end thereof connected to said third common line;

fourth and sixth inductors each having one end thereof connected to said fourth common line;

a second capacitor having one end connected in common to the other end of said fifth and sixth inductors;

a third capacitor having one end connected in common to the other end of said third and fourth inductors;

a first switch having one end connected to the other end of said second capacitor and the other end connected to said predetermined potential; and a second switch having one end connected to the other end of said third capacitor and the other end connected to said predetermined potential; and a second driver control circuit for generating said second driver control signals in response to an input scan signal, said second driver control circuit alternatively closing said second switch and said third switch in accordance with a scan electrode driving condition;

wherein said second driver control circuit comprises:

a first register composed of an "s"-stage shift register serially receiving a scan data signal in synchronism with a clock signal, for output a first register signal of "s" bits in parallel, where "s" is integer larger than one;

a second register composed of"s" latch circuits, for latching, in parallel, said "s" bits of said first register signal from said first register in response to a latch control signal, and for outputting a second register signal of "s" bits;

"s" exclusive-OR gates each receiving a pair of mutually corresponding bits of said first and second register signals, for detecting a logical transition in said scan data signal, to generate a transition detection signal;

"s" logic circuits each receiving a recovery/release control signal and said transition detection signal of a corresponding exclusive-OR gate of said "s" exclusive-OR gates, for generating a first control pulse; and "s" decoders each receiving said first control pulse of a corresponding logic circuit of said "s" logic circuits and a corresponding bit of said second register signal, for generating first to fourth on-off control signals for said first to fourth switches of a corresponding elementary driver circuit of said elementary driver circuits of said driver control circuit.

5. A display panel driving circuit claimed in claim 4 wherein wherein said second driver control circuit further includes "s" second exclusive-OR gates each receiving a polarity control signal and a corresponding bit of said second register signal, for generating a second control pulse, and each of said "s" decoders receives said first control pulse of said corresponding logic circuit of said "s" logic circuits and said second control pulse of a corresponding second exclusive-OR gate of said "s" second exclusive-OR gates, so that all of said elementary driver circuits are caused to carry out the same operation in parallel by controlling said polarity control signal.

6. A display panel driving circuit claimed in claim 4, wherein said first driver control includes:

a first register composed of an "s"-stage shift register serially receiving a driving data signal in synchronism with a clock signal, for output a first register signal of"s" bits in parallel, where "s" is integer larger than one;

a second register composed of"s" latch circuits, for latching, in parallel, said "s" bits of said first register signal, and for outputting a second register signal of "s" bits;

"s" exclusive-OR gates each receiving a pair of mutually corresponding bits of said first and second register signals, for detecting a logical transition in said driving data signal, to generate a transition detection signal;

"s" logic circuits each receiving a recovery/release control signal and said transition detection signal of a corresponding exclusive-OR gate of said "s" exclusive -OR gates, for generating a first control pulse; and "s" decoders each receiving said first control pulse of a corresponding logic circuit of said "s" logic circuits and a corresponding bit of said second register signal, for generating first to fourth on-off control signals for said first to fourth switches of a corresponding elementary driver circuit of said elementary driver circuits of said first driver control circuit.

7. A display panel driving circuit claimed in claim 6 wherein, during a period in which said recovery/release control signal is at an active level, said driver control circuit prevents said first register signal from being latched to said second register, and after an elapse of a predetermined time period from execution of each of the electric power recovery operation and the electric power release operation, said driver control circuit causes said second register to latch said first register signal, so that when no logical level transition occurs in said drive data signal, neither the electric power recovery operation or the electric power release operation is carried out.

8. A display panel driving circuit claimed in claim 7 wherein wherein said first driver control circuit further includes "s" second exclusive-OR gates each receiving a polarity control signal and a corresponding bit of said second register signal, for generating a second control pulse, and each of said "s" decoders receives said first control pulse of said corresponding logic circuit of said "s" logic circuits and said second control pulse of a corresponding second exclusive-OR gate of said "s" second exclusive-OR gates, so that all of said elementary driver circuits are caused to carry out the same operation in parallel by controlling said polarity control signal.

* * * * *